US005219043A

United States Patent [19]

Eriksson et al.

[11] Patent Number: 5,219,043

[45] Date of Patent: Jun. 15, 1993

[54] SUSPENDING SUPPORT FOR A CRANE CAB

[75] Inventors: Neal C. Eriksson; Michael D. James, both of Franklin; Jan B. Loebel, Muskego; Peter A. Kerrick, Brookfield, all of Wis.

[73] Assignee: Harnischfeger Corporation, Brookfield, Wis.

[21] Appl. No.: 810,056

[22] Filed: Dec. 19, 1991

[51] Int. Cl.[5] ..... B66B 11/04

[52] U.S. Cl. ..... 187/27; 212/213

[58] Field of Search ..... 187/9 E, 9 R, 11, 27; 212/153, 206, 213, 215, 216, 142.1, 97; 414/281, 277

[56] References Cited

U.S. PATENT DOCUMENTS 4,316,528 2/1982 Dechantsreiter ..... 212/213

4,538,954 9/1985 Luebke ..... 212/213

*Primary Examiner*—D. Glenn Dayoan

*Assistant Examiner*—Kenneth Noland

*Attorney, Agent, or Firm*—Richard C. Ruppin

[57] ABSTRACT

A support apparatus for the operator's cab of an overhead crane. The crane has a rigid depending mast and an intermediate mast and carriage vertically movable on the rigid mast for lifting and carrying a load. A hoist is mounted on the crane and attached to the carriage for raising and lowering the carriage, the intermediate mast and the load at normal operating speeds. The support apparatus includes a first support affixed to the cab and the intermediate mast for supporting the cab on the intermediate mast during normal operating speeds of the intermediate mast. The first support permits detaching the cab from the intermediate mast upon the occurrence of an excessive lowering operating speed of the intermediate mast. A second support affixed to the cab and to an overhead support of the crane then supports the cab in a suspended manner and the intermediate mast drops toward the floor below the crane without the cab. A sensing mechanism may also be provided for detecting excessive lowering overspeed of the intermediate mast and producing an indication of the overspeed to the second support. The second support is responsive to the excessive lowering speed indication of the sensing mechanism to support the cab.

28 Claims, 3 Drawing Sheets

SUSPENDING SUPPORT FOR A CRANE CAB

Field of the Invention

This invention relates to a suspending support for a crane operator's cab and, in particular, to an alternate cab support means which becomes effective in the event of loss of control of the movable support on which the cab is normally supported.

BACKGROUND OF THE INVENTION

In overhead cranes of the type having rigid masts depending from an overhead support and an intermediate mast and load carriage vertically movable on the rigid mast, it is desirable to provide an operator's cab mounted directly on the intermediate mast or carriage. This arrangement provides the crane operator with a view of the carriage necessary for picking up, moving and depositing a load with the carriage. However, if there is a loss of load, i.e., a loss of vertical movement control over the intermediate mast and/or the carriage on which the load is supported, the operator's cab will drop downward out of control with the intermediate mast, the carriage and the load.

Previous solutions to this problem have included providing safety jaws to "catch" the load. Such a device would be, for example, mounted on the intermediate mast for clamping against a vertical intermediate mast guide rail on the rigid mast if an overspeed condition occurs. However, use of these mechanisms becomes quite difficult as the load size increases. Another solution that has been used is to provide a separate operator's cab mast so that the operator is isolated from the load. However, use of two separate masts increases the overall width of the crane and is quite expensive.

SUMMARY OF THE INVENTION

It is an object of this invention to provide an overhead crane having a depending rigid mast and load lifting means vertically movable on the rigid mast with an operator's cab normally supported on the vertically movable load lifting means and detachable from and supportable by alternate means in the event of uncontrolled dropping of the load lifting means. It is a further object of the invention to provide an alternate second support for an operator's cab normally supported on a depending vertically movable load lifting means which becomes effective in the event of excessive speed dropping of the movable mast or carriage.

The objects of the invention are accomplished by providing an overhead crane having an operator's cab, a rigid depending mast, load lifting means vertically movable on the rigid mast, and hoist means mounted on the overhead crane and attached to the load lifting means for raising and lowering the load lifting means and the load it carries at normal operating speeds, with a first support means affixed to the operator's cab and the load lifting means for supporting the cab on the load lifting means during normal operating speeds of the load lifting means and detaching the cab from the load lifting means upon the occurrence of an excessive lowering speed of the load lifting means. A second support means is affixed to the cab and an overhead support of the crane for supporting the cab during excessive lowering operating speed of the load lifting means.

A sensing means may also be provided for detecting excessive lowering overspeed of the load lifting means and producing an indication of that overspeed to the second support means. The second support means is then responsive to the excessive lowering speed indication of the sensing means to support the cab.

The first support means for supporting the cab on the load lifting means comprises a first member affixed to the cab and a second member affixed to the load lifting means and having a position engaging the first member during normal operating speeds of the load lifting means. Upon the occurrence of an excessive lowering speed of the load lifting means, the second member is movable downward out of engagement with the first member so that the second support means becomes effective to support the cab. During normal operating speeds of the load lifting means, the first member is positioned in overlying engagement with the second member to thereby support the cab during normal operating speeds of the load lifting means.

The first and second members of the first means, which are in releasable holding engagement with each other, may also be vertically slidable. One of the members may include a stop means which permits only downward movement of the load lifting means relative to the cab so that, upon loss of control over the load lifting means and load, the load lifting means may move away downward from the cab and the cab support will be assumed by the second support means.

BRIEF DESCRIPTION OF THE DRAWINGS

Further objects and advantages of the invention will appear when taken in conjunction with the accompanying drawings, in which.

DESCRIPTION OF THE PREFERRED EMBODIMENT OF THE INVENTION

Figure 1:
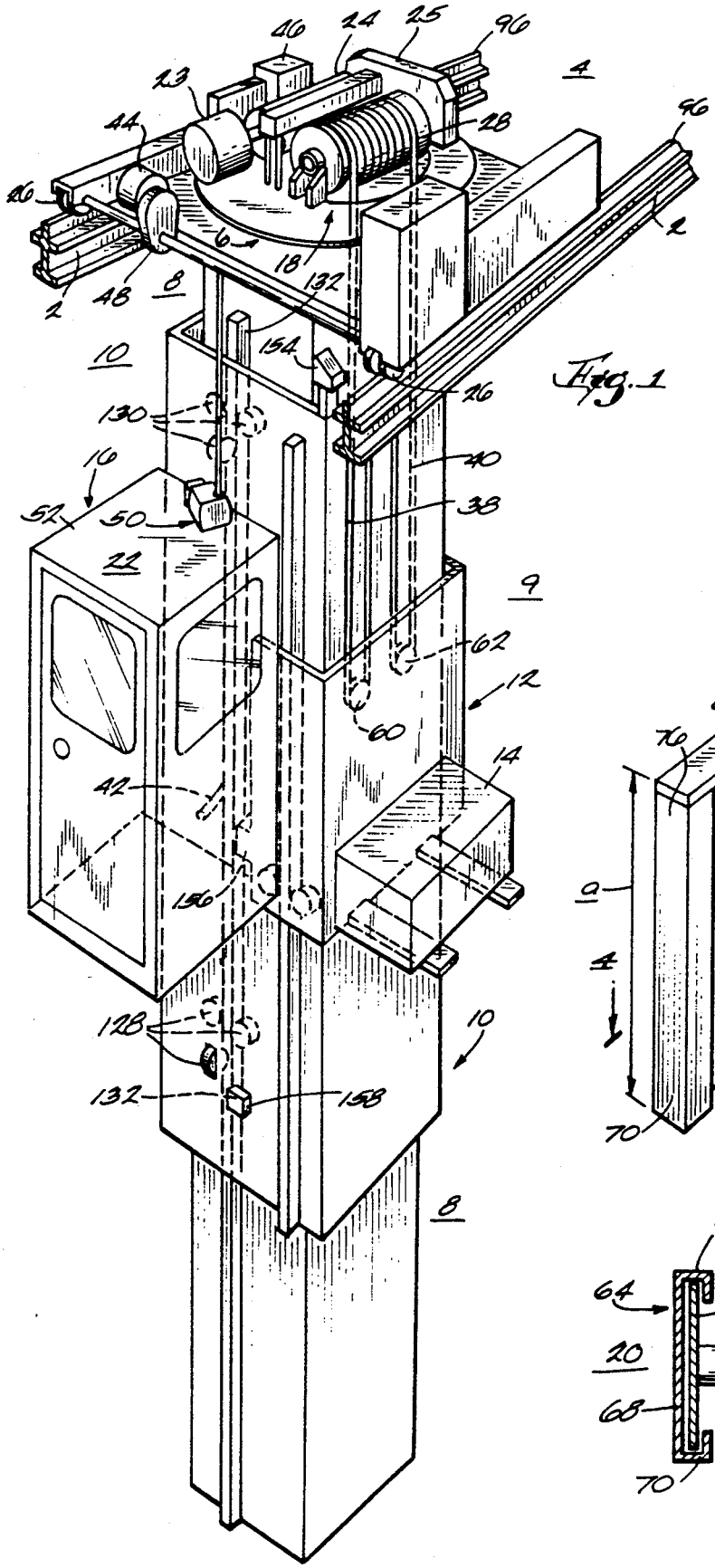
FIG. 1 is a perspective view of an overhead crane having a depending rigid mast and movable load lifting means mounted on the rigid mast and supporting an operator's cab and incorporating the apparatus of the present invention.
Figure 3:
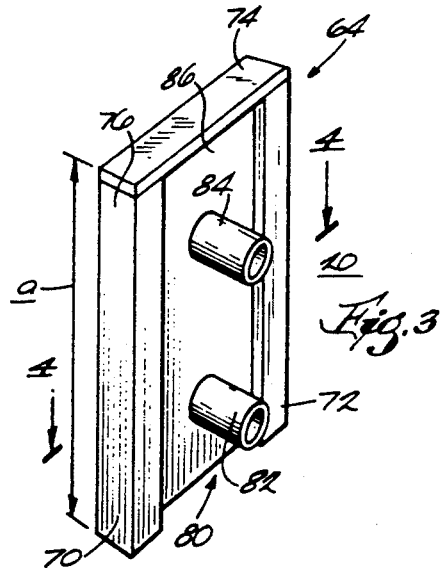
FIG. 3 is a perspective view of the means supporting the operator's cab on the load lifting means.
Figure 4:
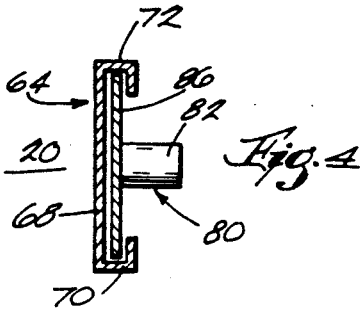
FIG. 4 is a cross-sectional view taken along lines 4—4 in FIG. 3.
Figures 2, 6:
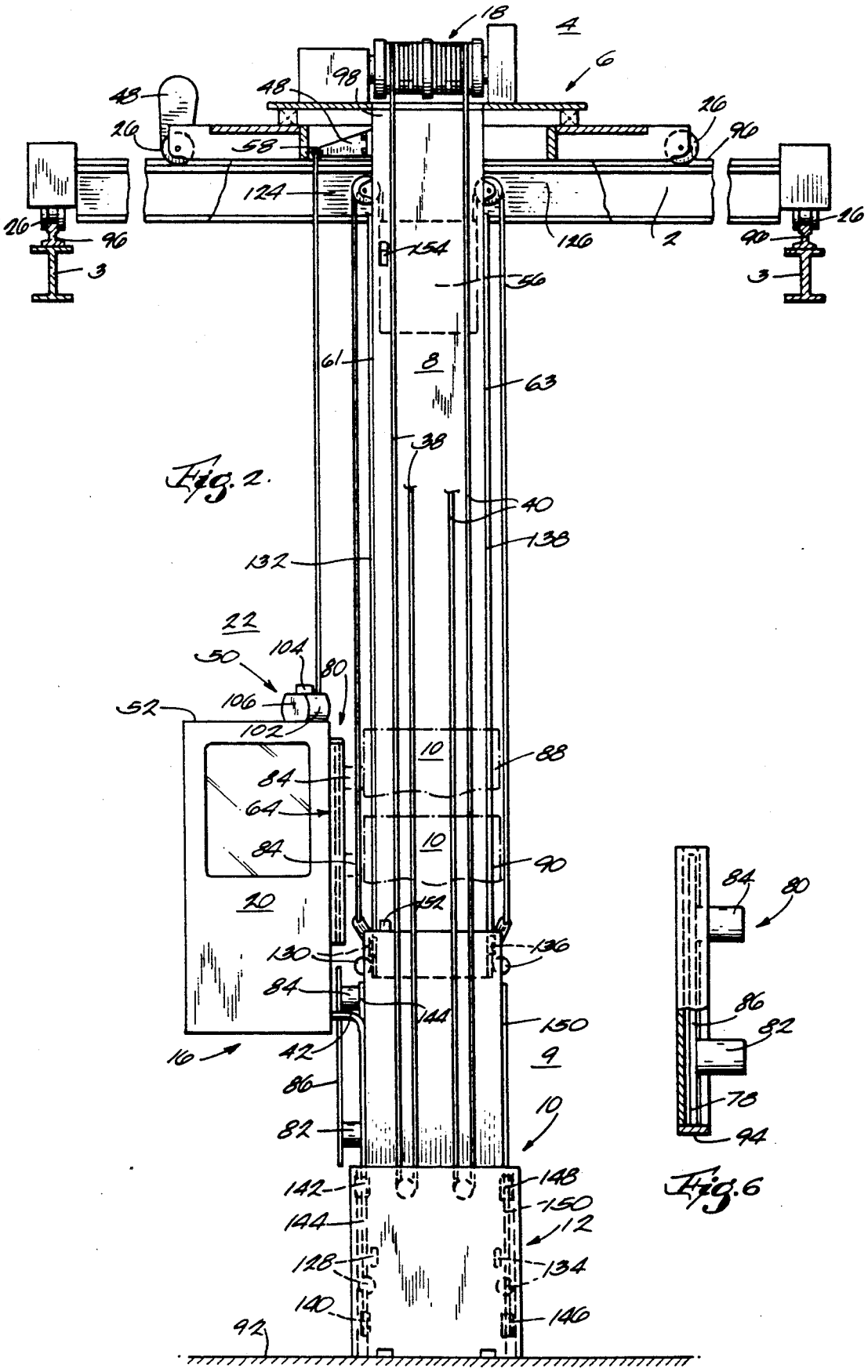
FIG. 2 is a side elevation view of the overhead crane illustrated in FIG. 1 in which the load lifting means is shown in two positions in phantom lines and in a third position in full lines.
FIG. 6 is a side elevation view of an alternative embodiment of the invention means for supporting the cab on the load lifting means.

Referring generally to FIGS. 1 and 2, an overhead crane is illustrated as having a pair of overhead beams 2 mounted on supports 3, a trolley 4 travelable on wheels 26 along rails 96 mounted on the pair of beams 2, a turntable 6 rotatably mounted on the trolley 4, and a fixed or rigid mast 8 which is rigidly supported on the underside of the turntable 6 in a suspended fashion. A load lifting means 9 is vertically movable on the rigid mast 8 and includes intermediate vertically movable mast 10 positioned around the rigid mast and a carriage 12 guided for vertical movement on the mast 10 for picking up a load 14 at a first location, lifting and carrying the load, and depositing it at another location. A turntable motor 46 is mounted on the turntable 6 for rotating the turntable and rigid mast 8 and thereby the intermediate mast 10 and carriage 12, about a vertical axis. An operator's cab 16 is supported on the intermediate mast 10 by releasable support means 20 and moves in vertical directions with the intermediate mast 10 during normal vertical movement operation of the intermediate mast. Alternate support means 22 is attached to the cab 16 and to an overhead support which may be the upper end 98 of the rigid mast 8 including an overhead bracket 48 affixed to the mast 8 for support of the cab 16 in the event of loss of control over the carriage, the load and the intermediate mast and their dropping at excessive speed.

A hoist 18 for raising and lowering the carriage and the load includes a motor 24, a brake 23, a gearbox 25, a drum 28 mounted on the turntable 6, sheaves 60 and 62 mounted on the carriage, and wire ropes 38, 40 reeved around the sheaves and affixed to the drum 28 and the turntable 6 for supporting the carriage on the hoist. The intermediate mast is supported on the rigid mast by a pair of sheaves 124 and 126 affixed to the rigid mast, a counterweight 56 positioned within the rigid mast, and a pair of wire ropes 61 and 63 respectively reeved over the sheaves 124 and 126 and each having opposite ends respectively attached to the intermediate mast and to the counterweight. The intermediate mast is vertically movable on the rigid mast and guided in its movement by rollers 128, 130 which bear against guide track 132 on the rigid mast and by rollers 134, 136 which bear against guide track 138 on the rigid mast. The carriage is vertically movable on the intermediate mast and guided in its movement by rollers 140, 142 which bear against guide track 144 on the intermediate mast and by rollers 146, 148 which bear against guide track 150 on the intermediate mast.

In the operation of the hoist 18, intermediate mast 10 and carriage 12, when the carriage is in a raised position the weight of the counterweight 56 on the ropes 61, 63 will pull the intermediate mast along the guide rails 132, 138 up to a maximum raised position as shown in FIG. 1 in which the bumper 152 engages the stop 154 on the rigid mast. The carriage is raised and lowered by rotation of the motor 24 and hoist drum 28 to take in or pay out ropes 38 and 40. When the carriage is lowered along the guide rails 144, 150 by rotation of the motor 24 and drum 28 so that its bumper 156 engages the stop 158 on the intermediate mast, the weight of the carriage on the intermediate mast is such that the weight of the carriage and intermediate mast together is sufficient to move them together downward against the weight of the counterweight 56 to a lowered position determined by the amount of ropes 38, 40 paid out by the hoist drum. When a load 14 is placed on the carriage at a lowered position and the carriage is then raised by the taking in of ropes 38, 40 on to the hoist drum, the intermediate mast will accompany the carriage upward, due to the raising of the mast 10 by the counterweight, until the mast bumper 152 engages the stop 154. When the mast 10 stops upward movement, the carriage may continue upward movement to its maximum raised position under the raising force of the ropes 38, 40.

The entire overhead crane is movable along supports 3 for the beams 2 by crane drive means (not shown). The trolley 4 is moved along the rails 96 on the beams 2 by a trolley motor 44 connected through a gearbox and axle 48 to two of the wheels 26. An electrical cable 42 has a normal position physically connected between the intermediate mast 10 and the cab 16 (see FIG. 1) and electrically connected between controls (not shown) in the cab 16 and the hoist motor 24, trolley motor 44, turntable motor 46, and crane drive means. The supports 3 for the overhead beams 2 permit movement of the overhead crane over a relatively large area, typically of a manufacturing or storage facility. The trolley 4 moves along the beams 2 to traverse the area over which the beams 2 travel to thereby provide access by the rigid mast 8 and movable mast 10 to the entire area over which the beams 2 travel. The turntable 6 rotates to provide circular positioning of the carriage 12 to assist with the picking up and depositing of loads 14. As previously described, the hoist is operated to enable the carriage 12 and intermediate mast 10 to pick up a load at a first position, carry the load as the trolley and overhead beams move to another location, and lower and deposit the load 14 at the new location. All movements and, in general, the entire operation of the overhead crane is controlled by an operator within the cab 16 using controls (not shown) connected to the electrical cable 42.

With reference to FIGS. 1–4, the releasable support means 20 includes a first member 64 having a length a and a C-shaped cross-section transverse to the length a. The member 64 includes an elongated plate 68 and retaining angle members 70, 72 affixed to the plate 68, which form the C-shaped cross-section. A stop means in the form of blocking bar 74 extends across an upper end 76 of the member 64. The releasable support means 20 further includes a second member 80 having projecting arms 82, 84 affixed to the intermediate mast 10 and extending toward the cab 16. An elongated slide plate 86 is affixed to the projecting arms 82, 84 and is normally positioned within the C-shaped cross-section of the first member 64 and retained in the first member 64 by the retaining members 70 and 72. During normal operation of the carriage 12 and the intermediate mast 10 at normal hoist, carriage and mast raising and lowering speeds, the blocking bar 74 of the first member bears against the slide plate 86 such that the cab 16 is entirely supported on the second member 80 and thereby on the intermediate mast 10 as shown in FIG. 2 by the phantom line 88 depiction of the mast 10. The slide plate 86 is slidable downwardly within the C-shaped first member 64 so that the cab 16 can b ®released and detached from the intermediate mast 10 in the event of loss of control over the carriage and intermediate mast so that the intermediate mast and carriage can drop downwardly at excessive speed.

Figure 5:
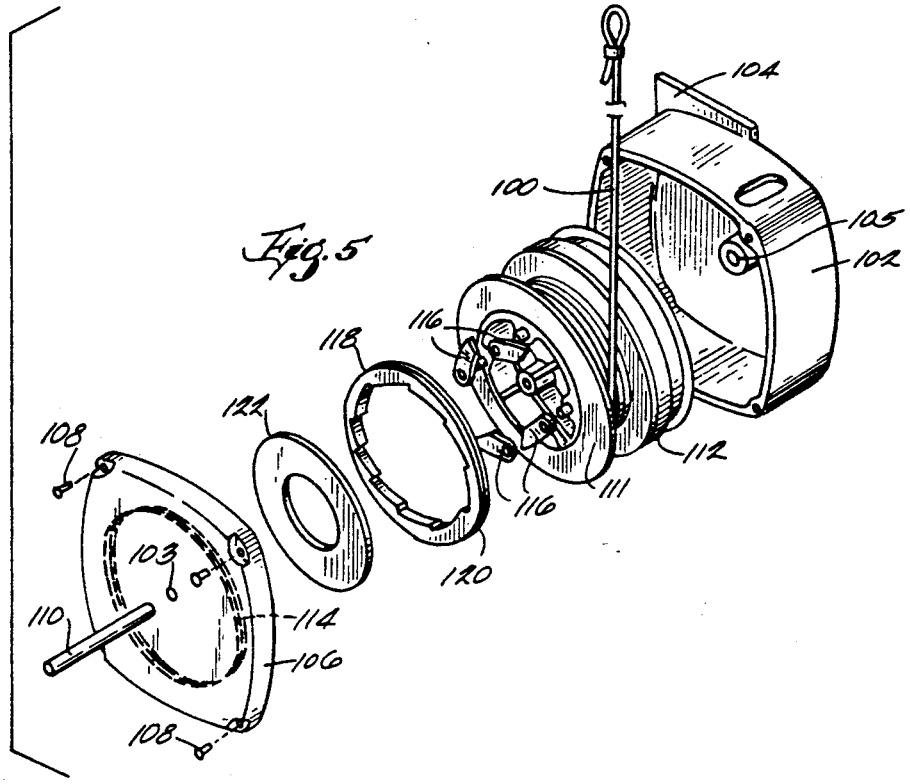
FIG. 5 is an exploded perspective view of an alternate means for supporting the operator's cab.

The second or alternate support means 22 is shown in FIGS. 1 and 2 and includes a load arrestor 50 having a wire rope 100. The load arrester is mounted on the top surface 52 of the cab 16 through bracket 104 affixed to the load arrestor and the cab top surface. The wire rope 100 extends upward from the load arrestor to the overhead bracket 48 and is attached to the bracket by bolt means 58. The load arrestor 50 is a well-known device commercially available from Sala Equipment AB and may be, for example, Sala Model LA 1000-12. An exploded view of the load arrestor 50 is shown in FIG. 5 and includes the wire rope 100, a housing 102 affixed to the mounting bracket 104, a housing cover 106 attached to the housing by screws 108 and having a threaded internal surface 114, and a drum shaft 110 extending through axially aligned openings 103 and 105 in the housing 102 and cover 106. Within the housing and cover, the load arrestor includes a rope drum 111 on which the rope 100 is wound, a drum spring 112 attached to the drum and the housing 102 for drawing the rope 100 in and keeping it under tension, ratchet pawls 116 pivotally mounted on the drum 111 for radially outward movement at an overspeed condition of the drum, a ratchet ring 118 having a threaded outer circumferential surface 120 in engagement with the threaded surface 114 of the housing, and a brake disc 122 positioned coaxially between the ring 118 and the cover 106. During normal lowering operation of the intermediate mast 10, carriage 12 and cab 16, the rope 100 is pulled off of the drum 111 against the tension of spring 112. During normal raising operation by the hoist, the rope 100 is taken in by the drum under the force of the drum spring. If the hoist 18 loses control over the carriage 12 and mast 10, the cab 16 will drop downwardly at an excessive overspeed which will cause the pawls 116 of the load arrestor to move radially outward into engagement with the ratchet ring 118. The ring 118 will then threadably advance, due to the engagement of its threads with the threads of the internal cover surface 114, in an axial direction toward the brake disc and cover to engage and tighten against the brake disc and brake the drum 111 and thereby the dropping cab to a stop.

The raising and lowering of the carriage 12, intermediate mast 10, and cab 16 are carried out at normal operating speeds determined by the speed of the hoist motor 24 and the gear ratios of the hoist gear box 25. During this normal operation of the hoist and intermediate mast, the cab is entirely supported on the intermediate mast by the releasable support means 20. In the event of loss of control over the intermediate mast 10 due to, for example, failure of the hoist motor 24 or the gear box 25, the carriage 12, the intermediate mast 10 and the cab 16 will be begin dropping downward at excessive speed. However, this overspeed condition will be detected by the movement of the ratchet pawls 116 of the load arrestor radially outward, i.e., the ratchet pawls act as an overspeed sensor. As previously described, radial outward movement of the pawls 116 causes stopping of the drum 111 and the downwardly moving cab and thereby the transfer of support of the cab to bracket 48 and rope 100 through the load arrestor 50. As the cab 16 comes to a halt in its downward movement due to support by the rope 100, the mast 10 will begin its downward movement relative to the cab as shown by the positioning of the mast 10 depicted by the phantom lines 90 in FIG. 2. The mast 10 continues downward with the carriage 12 so that the mast 10 becomes essentially completely detached and separated from the cab 16 as shown in the full lines of the intermediate mast 10 resting on the floor 92 of the facility in which the crane is located. Note that the electrical cable 42 may have torn away from the original normal attachment position to the intermediate mast 10 as shown in FIG. 1 when speed control of the mast 10 was lost and it dropped to the floor 92. However, the cable 42 continues to be positioned due to suspension of the cab 16 by the rope 10 at a position relative to the mast 10 such that the cable remains connected between the cab and the mast 10, as shown in FIG. 2. Thus, the cable acts to stabilize the movement of the cab and prevent it from undesired swinging and hitting of the masts 8 or 10.

With reference to FIG. 6, an alternative embodiment of the invention having a modified second support means 22 is shown. In the embodiment shown in FIG. 6, the blocking bar 74 across the upper end of the C-shaped first support member 64 is omitted and a blocking bar 94 as a stop means is affixed to the bottom end 78 of the slide plate 86 of the second support member 80. Thus, during normal raising and lowering speeds of the intermediate mast 10 and the cab 16, the first support member 66 rests against the blocking bar 94 so that the cab 16 is supported by the intermediate mast 10. However, upon the dropping of the intermediate mast 10 at an excessive overspeed condition sensed by the ratchet pawls 116 of the load arrestor 50 so that the cab 16 becomes supported by the rope 100, the intermediate mast and carriage are free to slide away so that the cab is detached from the intermediate mast and the intermediate mast 10 drops toward the floor.

Figure 7:
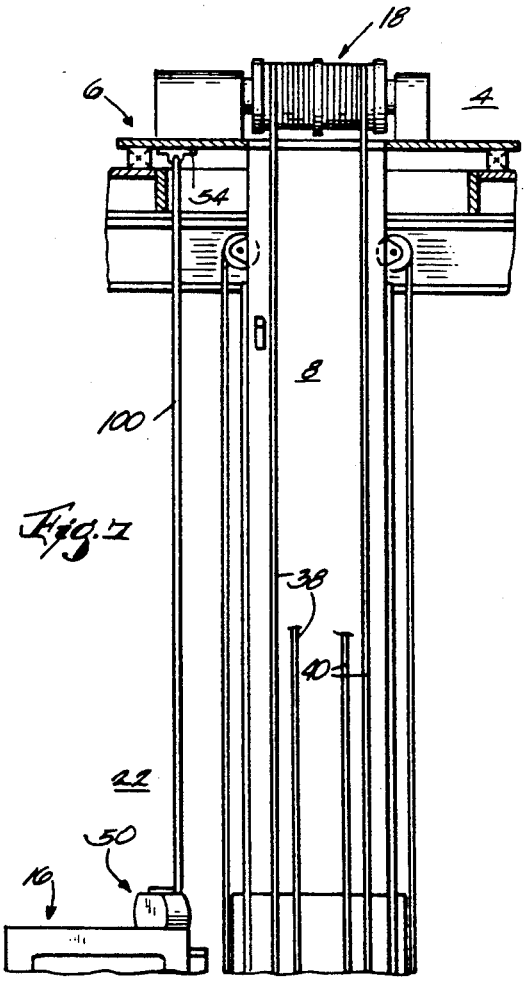
FIG. 7 illustrates an alternative embodiment of the invention having a modified mounting arrangement for the alternate means of supporting the cab.

Another alternate embodiment of invention is shown in FIG. 7. The embodiment of FIG. 7 provides an overhead support for the load arrestor 50 comprising an overhead bracket 54 affixed to the turntable 6. The rope 100 is attached to the bracket 54 with bolts 58 for support of the cab 16.

Figure 8:
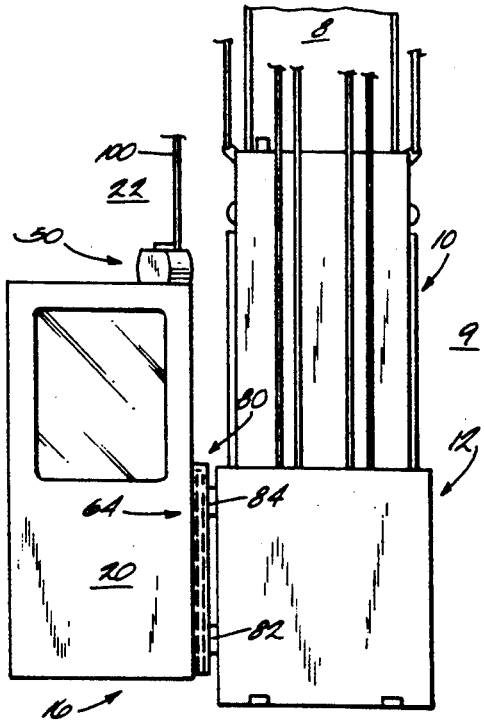
FIG. 8 is a side elevation view of an alternative embodiment of the invention in which the cab normally is supported on a vertically movable carriage of the load lifting means.

With reference to FIG. 8, an alternative embodiment of the invention is shown in which the releasable support means 20 is affixed to the carriage 12 rather than the intermediate mast 10. The various components relating to the support means 20 and its affixation to the carriage 12 are the same as for the embodiment shown in FIGS. 1 and 2, with the exception of the mounting of the cab at a higher position on the carriage to permit lowering of the latter to the level of the floor 92.

It will be understood that the foregoing description of the present invention is for purposes of illustration only and that the invention is susceptible to a number of modifications. For example, the load arrestor 50 could be mounted on the turntable with the wire rope from the load arrestor extending downward and attached to the cab. However, such modifications do not entail any departure from the spirit and scope of the present invention as defined in the hereto appended claims.

What is claimed is:

1. In a crane having an overhead support including a vertically depending rigid mast, load lifting means vertically movable on the rigid mast for lifting and carrying a load, hoist means mounted on the support and attached to the load lifting means for raising and lowering the load lifting means at normal operating speeds, the hoist means having a loss of load control condition in which in the load lifting means has an excessive lowering operating speed, the combination comprising:

an operator's cab;

first means affixed to the cab and to the load lifting means for supporting the cab on the load lifting means during normal operating speeds of the latter and detaching the cab from the load lifting means upon the occurrence of said excessive lowering operating speed of the load lifting means; and second means affixed to the cab and to the overhead support for supporting the cab during said excessive lowering operating speed of the load lifting means.

2. The combination according to claim 1 wherein:

the load lifting means comprises an intermediate mast vertically movable on the rigid mast at said normal operating speeds and also at said excessive lowering operating speed; and the first means comprises a first member affixed to the cab and a second member affixed to the intermediate mast and having a position engaging the first member during normal operating speeds of the intermediate mast, the second member being movable out of engagement with the first member upon the occurrence of an excessive lowering operating speed of the intermediate mast.

3. The combination according to claim 2 wherein the second member is movable downwardly from said position relative to the first member.

4. The combination according to claim 2 wherein the first member is positioned in overlying engagement with the second member during normal operating speeds of the intermediate mast whereby the cab is supported by the intermediate mast during normal operating speeds of the latter.

5. The combination according to claim 1 wherein:

the load lifting means comprises an intermediate mast vertically movable on the rigid mast at said normal operating speeds and also at said excessive lowering operating speed; and the first means comprises first and second members respectively affixed to the cab and affixed to the intermediate mast.

6. The combination according to claim 5 wherein the first and second members comprise a pair of relatively vertically slidable members, one of the members having a stop means for permitting only downward movement of the intermediate mast relative to the cab.

7. The combination according to claim 6 wherein the stop means bears against the other of the members for supporting the cab.

8. The combination according to claim 1 wherein:

the load lifting means comprises a carriage suspended from the overhead support and vertically movable relative to the rigid mast at said normal operating speeds and also at said excessive lowering operating speed; and the first means comprises a first member affixed to the cab and a second member affixed to the carriage and having a position engaging the first member during normal operating speeds of the carriage, the second member being movable out of engagement with the first member upon the occurrence of an excessive lowering operating speed of the carriage.

9. The combination according to claim 8 wherein the second member is movable downwardly from said position relative to the first member.

10. The combination according to claim 8 wherein the first member is positioned in overlying engagement with the second member during normal operating speeds of the carriage whereby the cab is supported by the carriage during normal operating speeds of the latter.

11. The combination according to claim 1 wherein:

the load lifting means comprises a carriage suspended from the overhead support and vertically movable relative to the rigid mast at said normal operating speeds and also at said excessive lowering operating speed; and the first means comprises first and second members respectively affixed to the cab and affixed to the carriage.

12. The combination according to claim 11 wherein the first and second members comprise a pair of relatively vertically slidable members, one of the members having a stop means for permitting only downward movement of the carriage relative to the cab.

13. The combination according to claim 12 wherein the stop means bears against the other of the members for supporting the cab.

14. The combination according to claim 1 wherein:

the operator's cab has a suspended position in which it is supported by the second means subsequent to the occurrence of the excessive lowering speed of the load lifting means; and further comprising;

an electrically conductive cable physically connected between the operator's cab and the load lifting means, the cable having a first normal position at normal operating speeds of the load lifting means and a second torn away position when the cab is in said suspended position, the cable remaining physically connected between the cab and the load lifting means in the second torn away position whereby the cable provides stability to suspended cab to minimize swinging of the cab.

15. The combination according to claim 14 wherein the suspended position of the cab relative to the load lifting means in such that the cab is not physically disconnected between the cab and the load lifting means.

16. In a crane having an overhead support including a vertically depending rigid mast, load lifting means vertically movable on the rigid mast for lifting and carrying a load, hoist means mounted on the support and attached to the load lifting means for raising and lowering the load lifting means at normal operating speeds, the hoist means having a loss of load control condition in which the load lifting means has an excessive lowering operating speed, the combination comprising:

an operator's cab;

first means affixed to the cab and to the load lifting means for detachably supporting the cab on the load lifting means during normal operating speeds of the latter;

sensing means for detecting an excessive lowering speed of the load lifting means and producing an indication of such excessive speed; and second means affixed to the cab and to the overhead support for supporting the cab on the overhead support during said excessive lowering operating speeds, the second means being in an inoperative condition during normal operating speeds of the load lifting means and being responsive to the excessive lowering speed indication of the sensing means to support the cab.

17. The combination according to claim 16 wherein:

the load lifting means comprises an intermediate mast vertically movable on the rigid mast at said normal operating speeds and at said excessive lowering operating speed;

the first means is affixed to the intermediate mast to thereby support the cab on the intermediate mast; and the intermediate mast is movable downward relative to the cab during excessive lowering speed of the intermediate mast whereby support of the cab on the intermediate mast is detached.

18. The combination according to claim 17 wherein the second means includes the sensing means.

19. The combination according to claim 16 wherein:

the load lifting means comprises a carriage suspended from the overhead support and vertically movable relative to the rigid mast at said normal operating speeds and also at said excessive lowering operating speed the first means is affixed to the carriage to thereby support the cab on the carriage; and the carriage is movable downward relative to the cab during excessive lowering speed of the carriage whereby support of the cab on the carriage is detached.

20. The combination according to claim 19 wherein the second means includes the sensing means.

21. The combination according to claim 16 wherein:

the load lifting means comprises an intermediate mast vertically movable on the rigid mast at said normal operating speeds and at said excessive lowering operating speed;

the first means is affixed to the intermediate mast to thereby support the cab on the intermediate mast; and one of the first and second members comprises a C-shaped cross-section channel member having opposite ends and the other member comprises a plate slidable in the channel member, and one of the first and second members has a blocking bar positioned across one of the ends of the channel member such that the intermediate mast is movable only downward relative to the cab.

22. The combination according to claim 16 wherein:

the load lifting means comprises a carriage vertically movable on the rigid mast at said normal operating speeds and also at said excessive lowering operating speed;

the first means is affixed to the carriage to thereby support the cab on the carriage; and one of the first and second members comprises a C-shaped cross-section channel member having opposite ends and the other member comprises a plate slidable in the channel member, and one of the first and second members has a blocking bar positioned across one of the ends of the channel member such that the carriage is movable only downward relative to the cab.

23. The combination according to claim 16 wherein:

the load lifting means comprises an intermediate mast vertically movable on the rigid mast at said normal operating speeds and also at said excessive lowering operating speed; and the first means comprises first and second members respectively affixed to the cab and affixed to the intermediate mast.

24. The combination according to claim 23 wherein the first and second members comprise a pair of relatively vertical slidable members, one of the members having a stop means for permitting only downward sliding movement of the intermediate mast relative to the cab.

25. The combination according to claim 24 wherein the stop means bears against the other of the members for supporting the cab.

26. The combination according to claim 16 wherein:

the load lifting means comprises a carriage vertically movable on the rigid mast at said normal operating speeds and also at said excessive lowering operating speed; and the first means comprises first and second members respectively affixed to the cab and affixed to the carriage.

27. The combination according to claim 26 wherein the first and second members comprise a pair of relatively vertical slidable members, one of the members having a stop means for permitting only downward sliding movement of the carriage relative to the cab.

28. The combination according to claim 27 wherein the stop means bears against the other of the members for supporting the cab.

* * * * *